US010612307B2

(12) United States Patent
Summers et al.

(10) Patent No.: US 10,612,307 B2
(45) Date of Patent: Apr. 7, 2020

(54) METHOD AND SYSTEM FOR DIRECTIONAL DRILLING

(71) Applicant: Schlumberger Technology Corporation, Sugar Land, TX (US)

(72) Inventors: Matthew Summers, Ovilla, TX (US); Ginger Vinyard Hildebrand, Houston, TX (US); Wayne Kotovsky, Katy, TX (US); Chunling Gu Coffman, Houston, TX (US); Rustam Isangulov, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 116 days.

(21) Appl. No.: 15/507,615

(22) PCT Filed: Jul. 23, 2015

(86) PCT No.: PCT/US2015/041645

§ 371 (c)(1),
(2) Date: Feb. 28, 2017

(87) PCT Pub. No.: WO2016/032640

PCT Pub. Date: Mar. 3, 2016

(65) Prior Publication Data

US 2017/0306702 A1 Oct. 26, 2017

Related U.S. Application Data

(60) Provisional application No. 62/042,869, filed on Aug. 28, 2014.

(51) Int. Cl.
*E21B 47/024* (2006.01)
*E21B 7/06* (2006.01)
(Continued)

(52) U.S. Cl.
CPC ..... *E21B 7/068* (2013.01); *E21B 7/10* (2013.01); *E21B 44/02* (2013.01); *E21B 44/04* (2013.01); *E21B 44/06* (2013.01); *E21B 47/024* (2013.01)

(58) Field of Classification Search
CPC ..... E21B 47/09; E21B 47/022
See application file for complete search history.

(56) References Cited

U.S. PATENT DOCUMENTS 6,438,495 B1 8/2002 Chau et al.
7,000,710 B1 2/2006 Umbach
(Continued)

FOREIGN PATENT DOCUMENTS

WO 2014121448 A1 8/2014

OTHER PUBLICATIONS

International Search Report and Written Opinion issued in corresponding International Application PCT/US20151041645 dated Sep. 21, 2015. 26 pages.

*Primary Examiner* — Shane Bomar
(74) *Attorney, Agent, or Firm* — Alec J. McGinn

(57) ABSTRACT

A method for wellbore directional drilling includes selecting a starting and stopping spatial position of at least one portion of the wellbore. A sequence of sliding and rotary drilling operations within the portion is determined to calculate a wellbore trajectory. The sequence has at least one drilling operating parameter. The operations include a constraint on the drilling operating parameter or the calculated trajectory. The calculated trajectory includes a projected steering response of a steerable motor in response to the at least one drilling operating parameter. Drilling the portion of the wellbore is started. A spatial position of the wellbore during drilling is determined at at least one point intermediate the starting and stopping positions. Using a relationship between the projected steering response and the drilling
(Continued)

operating parameter, the drilling parameter and/or the constraint are adjusted based on the measured spatial position and the stopping spatial position.

20 Claims, 5 Drawing Sheets

(51) Int. Cl.

| | |
|---|---|
| ***E21B 7/10*** | (2006.01) |
| ***E21B 44/02*** | (2006.01) |
| ***E21B 44/04*** | (2006.01) |
| ***E21B 44/06*** | (2006.01) |

(56) References Cited

U.S. PATENT DOCUMENTS

| | | | | |
|---|---|---|---|---|
| 7,059,427 | B2 | 6/2006 | Power et al. | |
| 7,139,689 | B2 | 11/2006 | Huang | |
| 7,957,946 | B2 | 6/2011 | Pirovolou | |
| 8,210,283 | B1 | 7/2012 | Benson et al. | |
| 8,360,171 | B2 | 1/2013 | Boone et al. | |
| 8,510,081 | B2 | 8/2013 | Boone et al. | |
| 8,528,663 | B2 | 9/2013 | Boone | |
| 8,596,385 | B2 | 12/2013 | Benson et al. | |
| 8,794,353 | B2 | 8/2014 | Benson et al. | |
| 8,996,396 | B2 | 3/2015 | Benson et al. | |
| 9,157,309 | B1 | 10/2015 | Benson et al. | |
| 9,347,308 | B2 | 5/2016 | Benson et al. | |
| 9,359,882 | B2 | 6/2016 | Snyder | |
| 9,404,356 | B2 | 8/2016 | Benson et al. | |
| 9,428,961 | B2 | 8/2016 | Benson et al. | |
| 9,494,030 | B2 | 11/2016 | Benson et al. | |
| 10,018,028 | B2 | 7/2018 | Benson et al. | |
| 10,196,889 | B2 | 2/2019 | Benson et al. | |
| 10,208,580 | B2 | 2/2019 | Benson et al. | |
| 10,358,904 | B2 | 7/2019 | Kyllingstad | |
| 2001/0042642 | A1* | 11/2001 | King | E21B 7/00 175/40 |
| 2004/0047234 | A1 | 3/2004 | Armstrong et al. | |
| 2004/0211596 | A1* | 10/2004 | Huang | E21B 10/00 175/38 |
| 2008/0281525 | A1 | 11/2008 | Boone | |
| 2008/0314641 | A1* | 12/2008 | McClard | E21B 7/04 175/57 |
| 2009/0000823 | A1* | 1/2009 | Pirovolou | E21B 7/04 175/61 |
| 2009/0090555 | A1 | 4/2009 | Boone et al. | |
| 2009/0152005 | A1* | 6/2009 | Chapman | E21B 7/00 175/24 |
| 2011/0024191 | A1 | 2/2011 | Boone | |
| 2011/0213601 | A1 | 9/2011 | Pirovolou | |
| 2011/0220410 | A1* | 9/2011 | Aldred | E21B 44/00 175/26 |
| 2013/0161096 | A1* | 6/2013 | Benson | E21B 7/04 175/26 |
| 2014/0049401 | A1* | 2/2014 | Tang | E21B 7/04 340/853.6 |
| 2014/0151121 | A1 | 6/2014 | Boone et al. | |
| 2014/0190747 | A1* | 7/2014 | Hay | E21B 41/0092 175/27 |
| 2015/0015250 | A1* | 1/2015 | Gzara | G01V 3/32 324/303 |
| 2015/0233229 | A1* | 8/2015 | Benson | E21B 7/06 700/275 |
| 2015/0247397 | A1* | 9/2015 | Samuel | E21B 44/005 700/275 |
| 2017/0037722 | A1 | 2/2017 | Jeffryes et al. | |
| 2019/0048707 | A1* | 2/2019 | Benson | E21B 3/02 |

* cited by examiner

METHOD AND SYSTEM FOR DIRECTIONAL DRILLING

CROSS-REFERENCE TO RELATED APPLICATIONS

This application claims priority to U.S. Provisional Patent Application Ser. No. 62/042,869, which was filed on Aug. 28, 2014, and is incorporated herein by reference in its entirety.

BACKGROUND

This disclosure is related to the field of directional drilling of subsurface wellbores. More specifically, the disclosure is related to optimizing performance of directional drilling using steerable drilling motors.

Wellbores drilled through subsurface formations are known in the art to be drilled along selected geodetic trajectories ("directional drilling") so as to traverse a path from the surface location of the well to one or more selected subsurface target positions located at predetermined depths and geodetic locations away from the surface location. One technique for directional drilling known in the art is to use "steerable motors" as part of a drilling tool assembly disposed proximate a bottom end of a drill string. A steerable motor is a device which couples within a drill string and is operated to rotate a drill bit coupled to an output end of the motor. The motor may be operated, e.g., by drilling fluid pumped through the drill string by one or more pumps disposed at the surface. Operating components of the motor that generate rotational energy to turn the drill bit are disposed in a housing that has a bend along its length. The angle subtended by the bend may range from a fraction of a degree to several degrees, depending on the particular selected trajectory for any part or all of a directionally drilled wellbore. Steerable motors are operated in one of two modes. In "rotary drilling" mode, the entire drill string, including the steerable motor, is rotated from equipment on a drilling unit ("rig") at the surface. The equipment may be a kelly/rotary table combination or a top drive. In rotary drilling mode, the direction along which the well trajectory exists (defined by geodetic azimuth and inclination from vertical) is maintained substantially constant, that is, the direction of the well does not change. When it is desired to change the well trajectory in any aspect, the rotation of the drill string is stopped and the steerable motor is oriented so that the bend in the motor housing is directed toward the intended change of direction in the well trajectory. Such operation is known as "slide drilling."

It is known in the art that slide drilling typically reduces the rate at which the wellbore is drilled ("rate of penetration"—ROP) as contrasted with rotary drilling. Thus, in order to minimize the time of a particular wellbore drilling operation, it may be desirable to minimize the amount of time engaged in slide drilling to drill the well along the selected trajectory. However, minimizing the sliding distance may require higher trajectory change rates, which may be limited by equipment capabilities and can result in increased wellbore tortuosity. Increased wellbore tortuosity may, for example, cause complications during wellbore completion operations. Therefore, the slide drilling—rotatory drilling sequences should be planned such that the overall speed of drilling is balanced with wellbore quality. Further, while the trajectory change effected by slide drilling for any particular configuration of steerable motor and drilling tool combination may be predicted with some degree of accuracy, the actual well trajectory response of any particular steerable motor and drilling tool combination may be affected by factors that may not be precisely known a priori, as non-limiting examples, the mechanical properties and spatial distribution thereof of the various subsurface formations, manufacturing tolerances in the drilling tool assembly and the particular steerable motor, the variability of the actual drilling parameters used (i.e., execution variability, namely the amount of time required to obtain the selected motor orientation during slide drilling may be highly variable and the ability to hold the correct orientation may be highly variable. Beyond that, predictions of directional drilling performance are based on assumptions about drilling parameters that may or may not be correct) and how the particular type of drill bit used interacts with the subsurface formations to drill through them to lengthen the wellbore. Still further, variations in the selected orientation angle of the bend in the motor housing may vary during sliding as a result of, among other factors, changes in reactive torque as the torque loading on the steerable motor changes. Such variations are impracticable to eliminate because of such factors as variability in friction between the wall of the wellbore and the components of the drill string and changes in the rate at which certain formations are drilled by the drill bit, among others.

DETAILED DESCRIPTION

Figure 1:
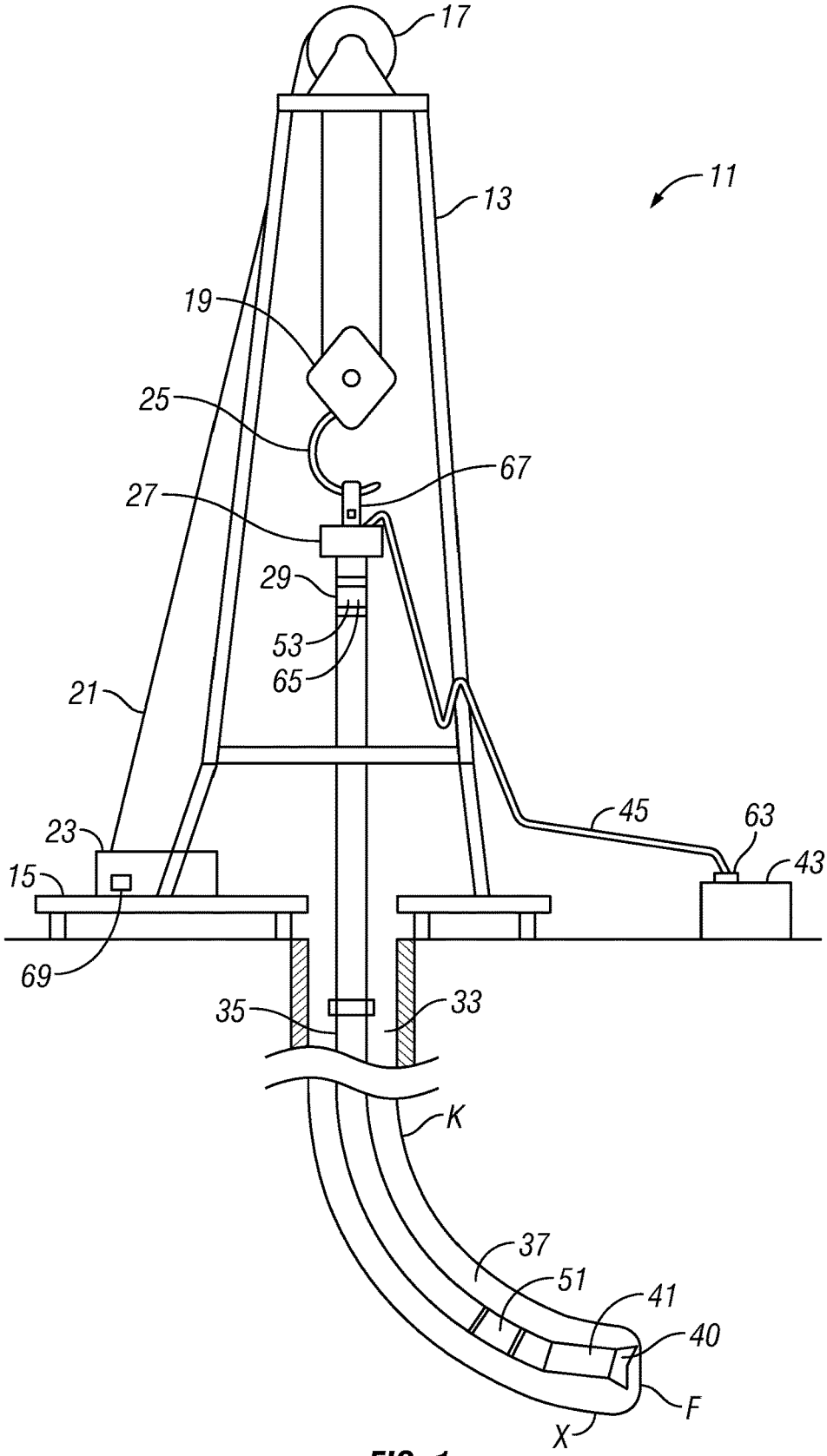
FIG. 1 is a schematic view of an example directional drilling system that may be used in accordance with the present disclosure.

FIG. 1 shows an example directional drilling system that may be used in some embodiments according to certain aspects of the present disclosure. A drilling rig ("rig") is designated generally by reference numeral 11. The rig 11 shown in FIG. 1 is a land rig, but this is for illustration purposes only, and is not intended to be a limitation on the scope of the present disclosure. As will be apparent to those skilled in the art, methods and systems according the present disclosure may apply equally to marine drilling rigs, including, but not limited to, jack-up rigs, semisubmersible rigs, and drill ships.

The rig 11 includes a derrick 13 that is supported on the ground above a rig floor 15. The rig 11 has lifting gear, which includes a crown block 17 mounted to the derrick 13 and a traveling block 19. The crown block 17 and the traveling block 19 are interconnected by a cable 21 that is driven by a draw works 23 to control the upward and downward movement of the traveling block 19. The traveling block 19 carries a hook 25 from which a top drive 27 may be suspended. The top drive 27 rotatably supports a drill pipe string ("drill string"), designated generally by reference numeral 35, in a wellbore 33. The top drive 27 may be operated to rotate the drill string 35 in either direction, or to apply a selected amount of torque to the drill string 35.

According to one example embodiment, the drill string 35 may be coupled to the top drive 27 through an instrumented top sub 29, although this configuration is not a limitation on the scope of the present disclosure. A surface drill string torque sensor 53 may be provided in the instrumented top sub 29. However, the particular location of the surface torque sensor 53 is not a limitation on the scope of the present disclosure. A surface drill pipe rotational orientation sensor 65 that provides measurements of drill string angular orientation or "surface" tool face may also be provided in the instrumented top sub 29. However, the particular location of the surface drill string orientation sensor 65 is not a limitation on the scope of the present disclosure. In one example embodiment, the instrumented top sub 29 may be a device sold by 3PS, Inc., Cedar Park, Tex. known as "Enhanced Torque and Tension Sub."

The surface torque sensor 53 may be implemented, for example, as a strain gage in the instrumented top sub 29. The torque sensor 53 may also be implemented as a current measurement device for an electrically operated rotary table or top drive motor, or as a pressure sensor for a hydraulically operated top drive. The drill string torque sensor 53 provides a signal which may be sampled electronically. The surface orientation sensor 65 may be implemented as an integrating angular accelerometer (and the same may be used to provide measurements related to surface torque). Irrespective of the instrumentation used, the torque sensor 53 provides a measurement corresponding to the torque applied to the drill string 35 at the surface by the top drive 27 or rotary table (not shown), depending on how the rig 11 is equipped. Other parameters which may be measured, and the corresponding sensors used to make the measurements, will be apparent to those skilled in the art and include, without limitation, fluid pressure in the drill string 35 and the weight suspended by the hook 29, which may be implemented as a sensor such as a strain gauge used as a hookload sensor 67. Measurements of the suspended weight may enable the rig operator ("driller") to estimate or determine the amount of the total drill string weight that is transferred to a drill bit 40 (called "weight on bit"—WOB) coupled to the end of the drill string 35. The drawworks 29 in some embodiments may include an automatic controller 69 of any type known in the art that can enable automatic control of the rate at which the drill string 35 is allowed to move into the wellbore, thus enabling automatic control over the WOB, among other parameters. One non-limiting example of such a drawworks controller is described in U.S. Pat. No. 7,059,427 issued to Power et al.

The drill string 35 may include a plurality of interconnected sections of drill pipe (not shown separately) and a bottom hole assembly ("BHA") 37. The BHA 37 may include stabilizers, drill collars and a suite of measurement while drilling ("MWD") instruments, including a directional sensor 51. As will be explained in detail below, the directional sensor 51 provides, among other measurements, toolface angle measurements, as well as wellbore geodetic or geomagnetic direction (azimuth) and inclination measurements.

A steerable drilling motor ("steerable motor") 41 may be connected near the bottom of the BHA 37. The steerable motor 41 may be, but is not limited to, a positive displacement motor, a turbine, or an electric motor that can turn the drill bit 40 independently of the rotation of the drill string 35. The steerable motor 41 may be disposed in an elongated housing configured to be coupled in the drill string 35. The housing may include a bend along its length. A direction of the bend in the steerable motor housing is referred to as the "toolface angle." The toolface angle of the steerable motor is oriented in a selected rotary orientation to correct or adjust the azimuth and/or and inclination of the wellbore 33 during "slide drilling", that is, drilling operations in which the drill bit 40 is turned only by the action of the steerable motor 41 while the remainder of the drill string 35 is controlled by the top drive 27 (or rotary table if the rig 11 is so equipped) to maintain the toolface angle. The toolface angle of the steerable motor 41 may be calibrated to toolface measurements made by the MWD directional sensor 51 after assembly of the BHA 37 so that the system user may be able to determine the steerable motor 41 toolface angle at selected times.

Drilling fluid is delivered to the interior of the drill string 35 by mud pumps 43 through a mud hose 45. During rotary drilling, the drill string 35 is rotated within the wellbore 33 by the top drive 27 (or kelly/rotary table if such is used on a particular rig). The top drive 27 is slidingly mounted on parallel vertically extending rails (not shown) or other similar structure to resist rotation as torque is applied to the drill string 35. As explained above, during slide drilling, the drill string 35 may be rotationally controlled by the top drive 27 to maintain a selected steerable motor toolface angle while the drill bit 40 is rotated by the steerable motor 41. The steerable motor 41 is ultimately supplied with drilling fluid by the mud pumps 43 through the mud hose 45 and through the drill string 35.

The driller may operate the top drive 27 to change the toolface orientation of the steerable motor 41 during slide drilling by rotating the entire drill string 35. A top drive 27 for rotating the drill string 35 is illustrated in FIG. 1, but the top drive shown is for illustration purposes only, as previously explained, and is not intended to limit the scope of the present disclosure. Those skilled in the art will recognize that systems and methods according to the present disclosure may also be used in connection with other equipment used to turn the drill string at the earth's surface. One example of such other equipment is a rotary table and kelly bushing (neither shown) to apply torque to the drill string 35. The cuttings produced as the drill bit 40 drills into the subsurface formations are carried out of the wellbore 33 by the drilling fluid supplied by the mud pumps 43.

The discharge side of the mud pumps 43 may include a drill string pressure sensor 63. The drill string pressure sensor 63 may be in the form of a pump pressure transducer in hydraulic communication with the mud hose 45 connected between the mud pumps 43 and the top drive 27 (or a swivel on kelly/rotary table rigs). The pressure sensor 63 makes measurements corresponding to the pressure inside the drill string 35. The actual location of the pressure sensor 63 is not intended to limit the scope of the present disclosure. Some embodiments of the instrumented top sub 29, for example, may include a pressure sensor configured to measure pressure inside the drill string 35.

When a portion of the wellbore 33 has its trajectory changed by slide drilling to a desired direction by slide drilling, if the intended or planned trajectory of the wellbore then includes maintaining such direction for a selected length or axial distance, the driller may operate the top drive 27 to rotate the entire drill string 35. Such operation is referred to as "rotary drilling" and when performed with a steerable drilling motor results in the direction of the wellbore remaining substantially constant.

Figure 2:
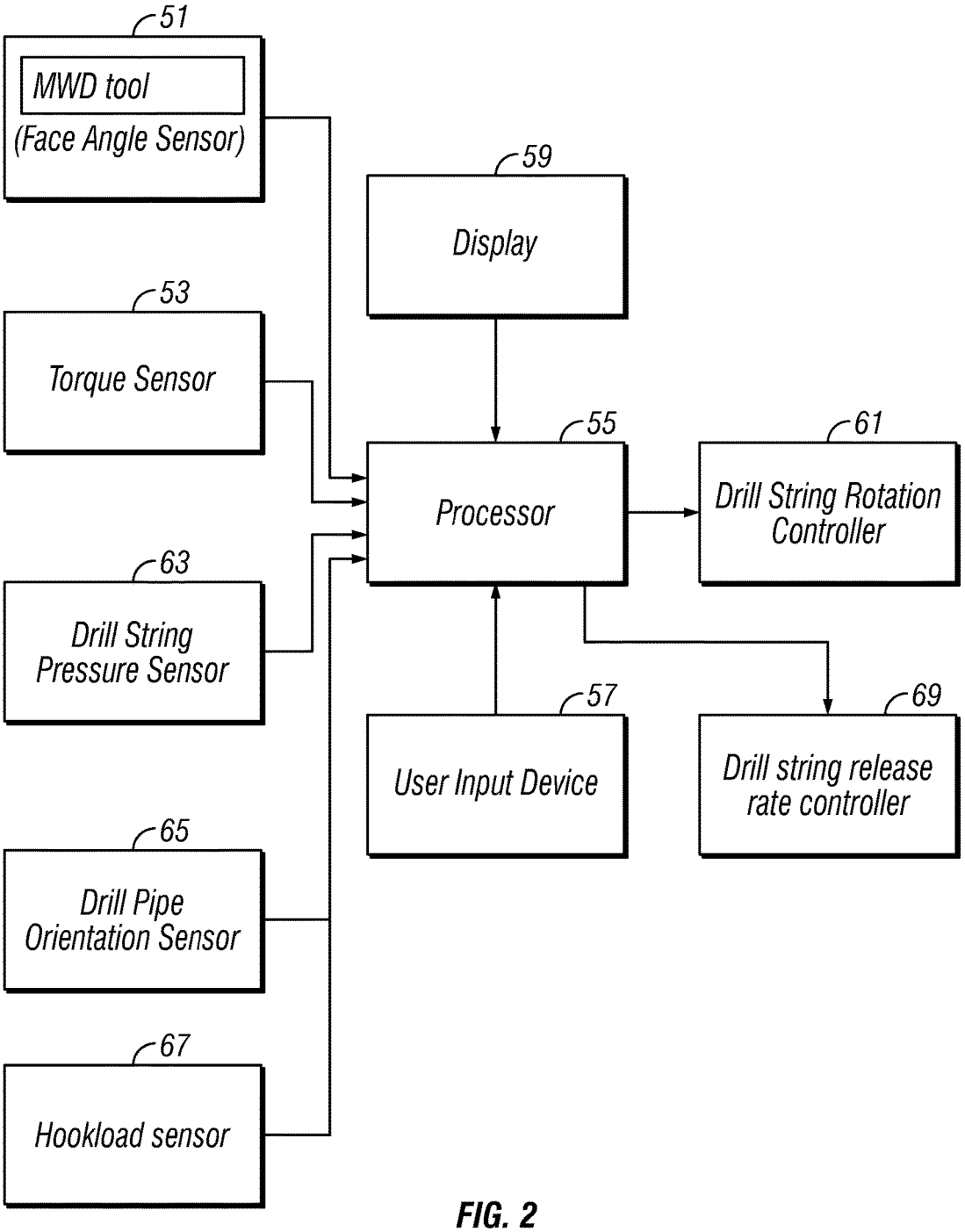
FIG. 2 is a block diagram of an example directional drilling control system according to the present disclosure.

FIG. 2 shows a block diagram of a directional drilling control system ("system") according to an embodiment of the present disclosure. The system may accept as input signals from devices including the directional sensor 51 (in an MWD system as explained with reference to FIG. 1, for example) which, as explained above, produces a signal indicative of the toolface angle of the steerable motor 41. The system may accept as input a signal from the drill string torque sensor 53. The torque sensor 53 provides a measure of the torque applied to the drill string (35 in FIG. 1) at the surface. The system may also accept as input a signal from the drill string pressure sensor 63 that provides measurements of the drill string internal fluid pressure. The system may also accept as input signals from the surface drill pipe orientation sensor 65. The system may also accept as input measurements from the hookload sensor 67. In FIG. 2 the outputs of the directional sensor 51, the torque sensor 53, the pressure sensor 63, hookload sensor 67 and the drill pipe orientation sensor 65 may be received at or otherwise operatively coupled to a processor 55. The processor 55 may be programmed to process signals received from the above described sensors 51, 53, 63, 67 and 65. The processor 55 may also receive user input from user input devices, indicated generally at 57. User input devices 57 may include, but are not limited to, a keyboard, a touch screen, a mouse, a light pen, or a keypad. The processor 55 may also provide visual output to a display 59. The processor 55 may also provide output to a drill string rotation controller 61 that operates the top drive or rotary table (FIG. 1) to rotate the drill string (35 in FIG. 1) in a manner as will be further explained below. The processor 55 may also provide output to operate the drawworks controller 69 to automatically control the WOB in some embodiments. In some embodiments, the processor 55 may be programmed to operate the drawworks controller 69 to provide a substantially constant value or other values of drill string fluid (mud) pressure a selected amount above the pressure existing when the drill bit (40 in FIG. 1) is not on the bottom of the wellbore (33 in FIG. 1) and thus exerts no torque (i.e., the no load pressure).

Referring again to FIG. 1, as the wellbore 33 drilling commences, the wellbore 33 may be substantially vertical. At a selected depth in the wellbore 33, called the "kickoff point" K, directional drilling along a selected trajectory may be initiated. Initiating directional drilling may be performed by having the driller operate the top drive 27 (or kelly/rotary table if such are used on a particular rig) to rotate the drill string 35 to a rotary orientation such that a selected toolface angle (as may be measured by the directional sensor 51) of the steerable motor 41 is obtained. The drill string 35 may be lowered into the wellbore 33 such that some of the axial loading (weight) of the drill string 35 is transferred to the drill bit 40. When the drill bit 40 engages the subsurface formations and begins to drill them, the steerable motor 41 will exert torque on the drill bit 40. A reactive torque will be generated and applied to the drill string 35, the reactive torque being in a direction opposite to the torque generated by the drilling motor 41. The driller may operate the top drive 27 to apply torque in a direction opposite to the reactive torque such that the selected steerable motor toolface angle is substantially maintained. It will be appreciated by those skilled in the art that when the wellbore is substantially vertical, the toolface measurement may be referenced to a geodetic or geomagnetic reference. Such toolface measurement may be referred to as "magnetic toolface" (MTF). As the wellbore inclination increases above a threshold level (usually about five degrees from vertical), the toolface angle measurement may be referenced to Earth's gravity (i.e., vertical). Such toolface measurement may be referred to as "gravity toolface" (GTF).

The orientation sensor 65 may generate a signal indicative of the drill string 35 rotational orientation at the surface when such conditions are maintained. As will be appreciated by those skilled in the art, the actual rotational orientation of the drill string 35 as measured by the orientation sensor 65 may depend on, among other factors, the length of the drill string 35 and the torsional properties of the components of the drill string 35. Thus, the measured drill string orientation at the surface may differ from the measured toolface angle (e.g., by directional sensor 51), however, provided that the same surface measured rotational orientation is maintained, it may be assumed for purposes of relatively short lengths of the wellbore, limited in length to a selected number (e.g., one or two) of segments of drill pipe making up the drill string 35 that maintaining a selected surface measured drill string orientation will result in the toolface angle of the steerable motor 41 being similarly maintained (provided that other drilling operating parameters are maintained). The foregoing relationship between the surface measured drill string orientation and the steerable motor toolface angle may prove useful if the toolface measurement from the directional sensor 51 is communicated to the surface using MWD telemetry techniques known in the art, which may provide only one to three toolface measurements per minute at the surface. During directional drilling, each time one or more segments are added to the drill string 35 or it is otherwise lengthened from the top drive (or kelly) to the drill bit 40, the relationship between the measurement made by the drill string orientation sensor 65 and the toolface orientation (as may be measured by the directional sensor 51) may change, but the relationship may be readily reestablished for the changed length drill string 35.

Directional drilling by slide drilling as described above may continue until a desired wellbore inclination angle and subsurface location away from the surface location are obtained, such as indicated at X in FIG. 1. Thereafter, the wellbore 35 may be drilled, for example, along a substantially constant trajectory or any other selected trajectory to another selected subsurface location point, e.g., as indicated by F in FIG. 1. The foregoing maintaining the toolface angle of the steerable motor 41 by maintaining a measured drill string orientation at the surface may be performed automatically by operation of the drill string rotation controller (61 in FIG. 2) in response to command signals generated by the processor (55 in FIG. 2). The processor 55 may be programmed to maintain a selected surface measured orientation of the drill string by suitable programming to respond to the sensor inputs as described with reference to FIG. 2 and particularly with respect to the measurements of torque and rotational orientation of the drill string made at the surface. Maintaining orientation of the drill string so that the toolface angle as measured by the MWD directional sensor 51 may also be manually performed by the driller operating the top drive 27 and drawworks 23 such that the directional sensor measurements of toolface correspond to the desired change in direction of the wellbore trajectory.

Figure 3:
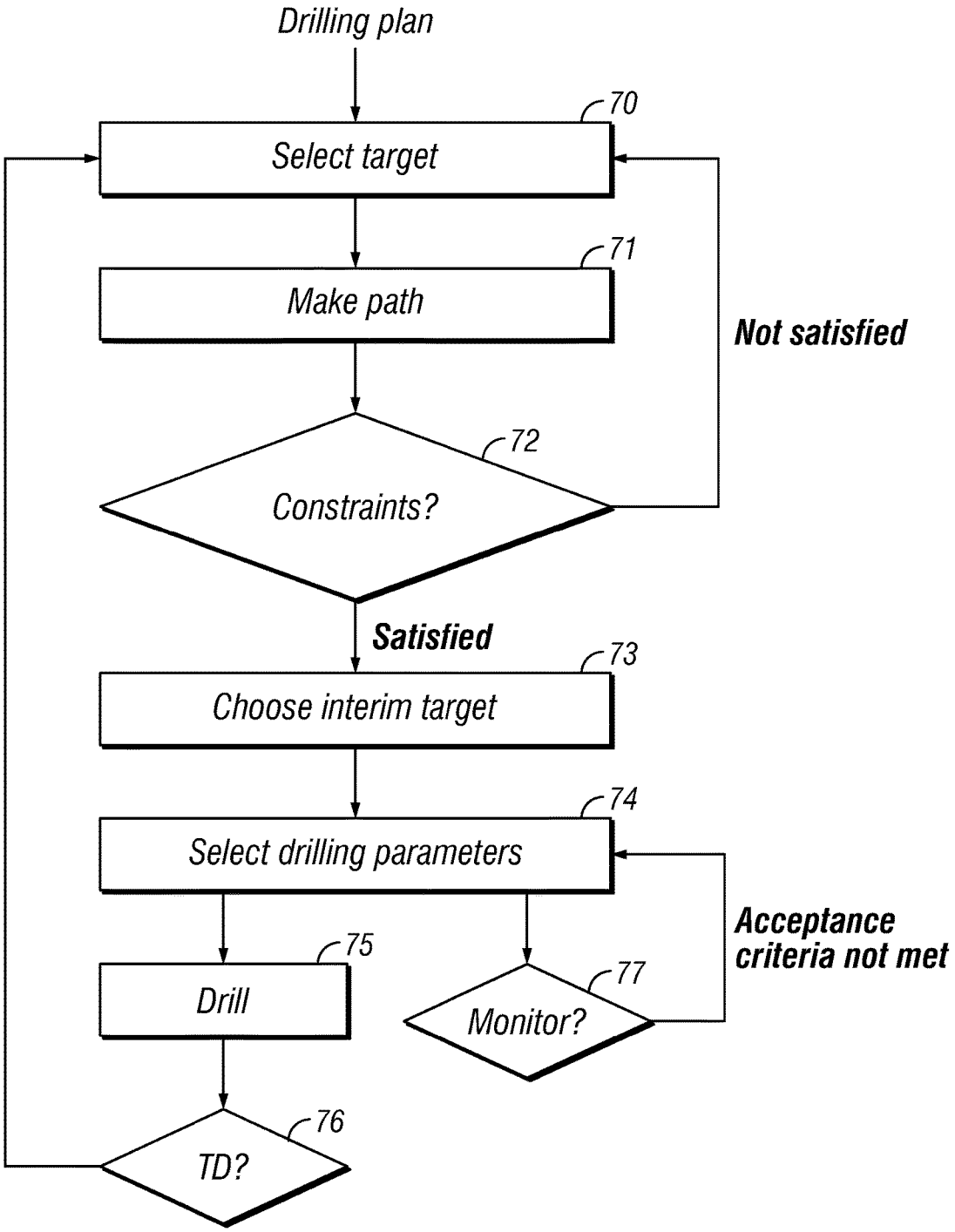
FIG. 3 shows a flow chart of an example directional drilling method.

In an example method for directional drilling according to the present disclosure, and referring to FIG. 3, a drilling plan may include a surface geodetic position of a wellbore, as shown in FIG. 1, and one or more subsurface "target" geodetic positions 70. For the wellbore to traverse the geodetic distance and subsurface depth from the surface position to the one or more subsurface target positions, a well path (or trajectory) may be selected at 71. The well path may be selected based on certain constraints at 72. The constraints may include, without limitation, a minimum acceptable radius of curvature of the well path (referred to as a maximum "dog leg severity"), the turn/build capability of the particular steerable motor, the maximum permissible true vertical depth (TVD) of the wellbore, the minimum inclination of the wellbore from vertical, a predetermined permissible distance from other wellbores, lease lines, anti-targets, or other constraints and a maximum distance at any point along the well trajectory between the actual well trajectory and the predetermined well plan trajectory.

In an example embodiment, an optimization may be performed to generate a preferred well trajectory. The optimization may include an algorithm to select a path which meets one or more optimization criteria. Non-limiting examples of such optimization criteria may include minimized dog leg severity, minimized torque and drag inducing factors, e.g. total curvature, well path tortuosity, limiting path curvature in specific spatial regions, especially to avoid slide drilling in certain formations, total path length to any one or more targets, selected intermediate subsurface well positions being along the selected trajectory, slide drilling length criteria (e.g., not sliding less than or more than a predetermined wellbore length) and maximizing drilling penetration rate (ROP) for any one or more selected segments of the wellbore. ROP in the present context may mean instantaneous drilling rate, or may mean a minimized time to drill a selected length of the wellbore.

One or more intermediate targets along the well trajectory may be selected as explained above at 73 in FIG. 3. At 74, and as will be explained below with reference to FIG. 4, drilling operating parameters 74 may be selected to cause the well to be drilled along the selected well path. At 75, drilling may commence using the selected drilling operating parameters. During drilling, the actual position of the wellbore with reference to the planned trajectory as well as the actual drilling parameters may be measured. If it is determined that the one or more well path targets may be reached by using drilling parameters and well path parameters within the constraints, at 77, drilling the well may continue. At 76, if any one or more intermediate or the final target cannot be traversed by the wellbore using drilling operating parameters and well path parameters within the selected constraints, the process may return to 70, wherein it may be required to generate a different well trajectory capable of traversing the remaining target location(s) while maintaining drilling operating parameters and well trajectory parameters within the constraints. In some embodiments, one or more of the constraints may be adjusted or removed. Such adjustment or removal may depend on, e.g., and without limitation, the expected risk of wellbore or drill string mechanical failure, risk of collision with another well, risk of unacceptably traversing a geodetic boundary, or creating a well path having tortuosity such that completion of wellbore construction such as by cementing a casing or liner is made impracticable. The foregoing are only examples of constraint modification or removal considerations and are not to be construed as limitations on the scope of the present disclosure.

If a well trajectory cannot be constructed such that the constraints are satisfied, then a new target may be selected. In this case, an additional mechanism may be used to select the target. In some embodiments, the processor (55 in FIG. 2) or another processor (see FIG. 5) may be programmed to automatically shift the original target(s) further along the selected trajectory (i.e., at greater measured depth) where constraints such as those mentioned above can be satisfied. In some embodiments, if the target(s) cannot be shifted within a selected measured depth range while still satisfying the constraints described above, the processor may be programmed to generate a warning indicator to remove the drill string (FIG. 1) from the wellbore and change one or more components of the BHA. In some embodiments, as explained above, one or more of the constraints may be adjusted or removed under such conditions to enable reaching the depth-shifted target(s).

In some embodiments, the total well path may be subdivided into selected length (measured depth) intervals and the optimization described above may be performed for each interval or any subset thereof. The foregoing element of a directional drilling process is equally applicable to any point along the actual trajectory of the wellbore at any measured depth. That is, not only is the surface position usable as a starting point, any point during the drilling of the wellbore may be used as a starting point for further directional drilling to a subsequent intermediate target point or to a final target point at the planned end (maximum measured depth) of the wellbore.

From the initially generated wellbore trajectory, one or more intermediate target(s) along the well path may be selected based on criteria, e.g., and without limitation, user selection based on the initially planned trajectory, any one or more estimated subsequent well trajectory directional survey points, drill string stand length and/or on substantially equal length well segments.

The drilling operating parameters (at 74 in FIG. 3) may be selected based on an example procedure as follows. For a planned section of a wellbore, a model f (d1, d2, tf, WOBs, WOBr, RPM, . . . )=xt, vt, T, . . . may be used to predict the resulting wellbore geodetic spatial location xt, wellbore orientation vt, and required drilling time T as a function of the slide drilling measured depth interval (from d1 to d2), the toolface orientation TF used while slide drilling, the weights on bit WOBs and WOBr used while slide drilling and rotary drilling, respectively, and the RPM used while rotary drilling, and other inputs as may be available and useful. Examples of other inputs to the model f may include slide drilling differential pressure (i.e., increase in drilling fluid pressure above the no load pressure when WOB is zero) and drilling fluid flow rate. Examples of other outputs of the model may include drilling tool/BHA component and drill string component wear indicia. For any segment of the wellbore which is not intended to be drilled along a substantially constant direction, a model f (d1, d2, tf)=xt, vt may be used to predict the resulting wellbore geodetic spatial location xt and wellbore geodetic orientation vt based on selected drilling operating parameters and a measured slide drilling toolface angle. By inverting for applying optimization methods, the parameters d1, d2, tf, WOBs, WOBr, RPM, etc. may be determined in order to reach a target xt, vt, within a desired amount of time while satisfying other constraints (e.g. equipment wear, well path tortuosity, etc.). A starting interval depth d1, an ending interval depth d2, and a slide drilling toolface angle tf are determined. The model f may be used to predict the elapsed time, wellbore location/orientation, sliding efficiency factor ("SEF") and torque and drag properties for each selected wellbore interval of slide drilling as a function of various drilling operating parameters and optionally formation properties. The drilling operating parameters may include slide drilling depth interval(s), WOB, toolface orientation(s), drill string fluid pressure and bit rotary speed (RPM). Optimization methods and inverted models may be used to find the parameters that optimize one or more drilling performance parameters while satisfying the constraints. In its simplest form, the model f may be inverted for d1, d2 and tf. However, other embodiments may use as input additional parameters such as explained above, including without limitation slide drilling WOB, rotary drilling WOB, rotary drilling bit RPM, slide drilling mud flow rate, and rotary drilling mud flow rate. Some embodiments may invert f for a single slide drilling interval. Other embodiments may determine the foregoing parameters for multiple slide drilling intervals.

Input parameters to the model f may include SEF, sliding curve response ("SCR"), tool face offset (TFO—the difference between the measured toolface from the directional sensor [51 in FIG. 2] and the actual steering response of the steerable motor (and its directional tendencies during rotary drilling) as determined by directional surveying at selected positions along the well trajectory) and trajectory constraints. SCR and SEF may be adjusted during drilling of the wellbore (starting using initial values based on expected response values from the drill string, drilling operating parameters and the BHA components, including the specific steerable motor). SEF sensitivity to weight on bit can be determined in order to optimize ROP without sacrificing steering constraints. In an example embodiment, SCR may be used in the form of a weighted average based on measurements of the change in wellbore trajectory with respect to measured toolface angle and slide drilling interval length as will be further explained below.

The slide drilling interval(s) and associated parameters may be selected to obtain, for example, a desired well trajectory curvature, minimized well path tortuosity, and/or minimized distance to any one or more intermediate predetermined trajectory points along the planned well trajectory. The slide drilling interval(s) can also be selected to keep the borehole within some particular volume in space. Such a volume can be defined for example as the volume of points within various metrics of a reference trajectory, for example, the set of all points within 10 feet true vertical depth (TVD) above, 5 feet TVD below, 20 feet left and 20 feet right of the reference trajectory. The volume need not be centered on the reference trajectory, for example in a curved section the volume may lie more (or completely) on the concave side of the curve. The reference trajectory may be, for example, a well plan. Slide intervals would be placed appropriately before a substantially straight trajectory would exit the volume, taking into account position and orientation uncertainties and the finite turning capability C of the BHA. Slide intervals and associated parameters may also be selected based on borehole quality characteristics such as maximum dog leg severity (DLS) or borehole tortuosity as well as good directional drilling practices such as not slide drilling down while in a curve section. It may not be possible to satisfy all constraints simultaneously. In such circumstances, then the system can apply a preprogrammed prioritization or a user selected prioritization scheme, or the system may request user input as to instructions for how to resolve the conflict.

In some embodiments the driller or other system user may select drilling operating parameters (WOB and/or drill string pressure when slide drilling and rotary drilling and drill string RPM while rotary drilling) to optimize ROP while maintaining the measured well path within predetermined tolerances from the planned well path and/or constraints on the drilling operating parameters. The foregoing may be performed to, for example and without limitation, optimize the ROP along any one or more selected intervals of the wellbore or to minimize the specific energy needed to drill one or more selected wellbore intervals. Directional drillers often intentionally limit WOB below that which would produce optimum ROP in order to reduce variability in toolface orientation. Such variation in toolface orientation may result from variations in bit torque and consequent reactive torque applied to the steerable motor when WOB approaches the optimum value for maximizing ROP. Thus, the intent is to enable better control over the well trajectory at the cost of reducing the speed with which the wellbore is drilled. The optimization of the model f may enable determining when WOB can be increased without reducing stability of trajectory control (i.e., increasing the toolface variation) or exceeding other drilling constraints. In some instances it may be desirable to intentionally reduce trajectory control if such reduction either or both increases ROP substantially and does not result in deviation of the well trajectory from limits on such deviation.

In some embodiments, there may be one optimization that not only optimizes the generated initial wellbore trajectory but also simultaneously optimizes the depth intervals of individual slide drilling/rotary drilling sections of the wellbore and the drilling operating parameters used therein. In some embodiments there may be two optimization functions, one for the generated well trajectory and one for any individual stand or incremental drilling length. In some embodiments there may only be one optimization for the entire well trajectory. In some embodiments there may only be one optimization for any one or more individual segments (e.g., stands) of the drill string. In some embodiments, there may be no optimization.

1. In slide drilling, frictional forces and reactive torque affect the ability to precisely control WOB, which in turn affects toolface orientation and/or control of toolface orientation (measured toolface). As a result, the ability to select and maintain the toolface orientation may need to accommodate interrelated considerations of WOB, toolface, reactive torque and friction forces. In slide drilling, toolface direction includes both instantaneous values and accumulated toolface values over time. In order for the system users (e.g., including the driller) to have a better understanding of the trajectory of the borehole, in some embodiments, a depth weighted toolface direction may be calculated and may be displayed. The weighted average toolface direction may be provided on any selected depth interval basis, e.g., on a per stand basis, on a per well section basis, or to monitor results after a change in a target well path location (e.g., a well placement decision). One example of how the weighted average toolface may be presented is provided below. The drilling depth for each measured toolface value (e.g., from the MWD instrument) along a selected depth interval may be displayed and recorded and the actual change in well trajectory over the selected interval (steering curve response or SCR) may be calculated to provide the depth weighted average (referred to as "C") of the SCR. Measurements of toolface variation may comprise one or more of a difference between successive tool-face measurements, an absolute deviation, a variance, a range, a norm of the average of vectors representing tool-face orientations, a modulus of an average of complex numbers representing the tool-face orientations.

Figure 4:
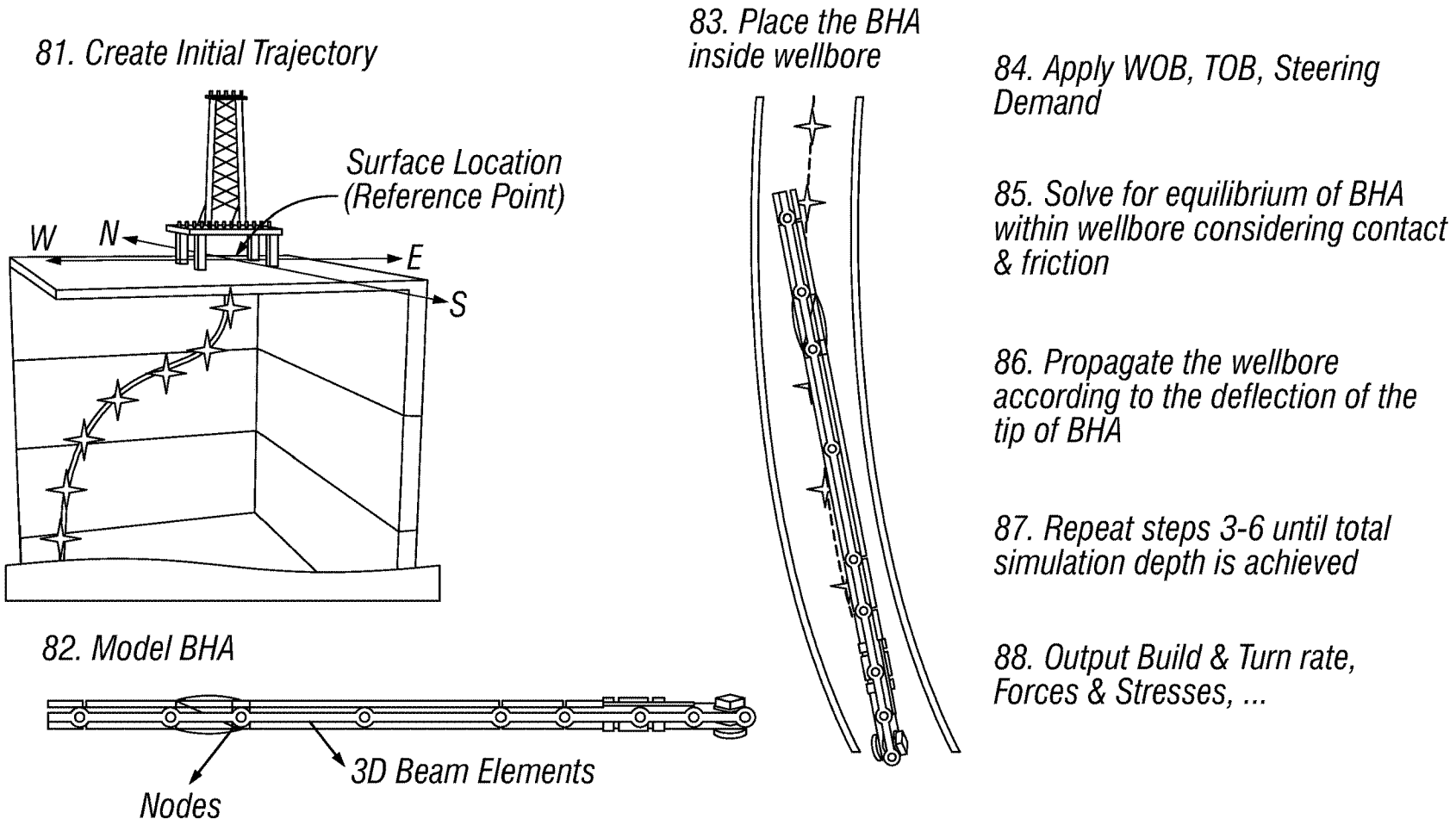
FIG. 4 shows an example of non-linear finite element analysis of expected drilling tool and steerable motor response.

In an example embodiment according to the present disclosure, drilling operating parameters may be initially selected based on a modeled response of the drill string and BHA to particular values of or ranges of drilling operating parameters. One such model may be based on non-linear finite element analysis. Referring to FIG. 4, an initial well path or trajectory may be selected as shown at 81. At 82, the drill string BHA may be modeled as to their mechanical properties in a selected mesh, including elastic and shear moduli and mass for forming a three dimensional model of all the components of the drill string and BHA. At 83, the modeled drill string and BHA may be placed in a modeled wellbore, having selected mesh elements representing subsurface formations, including properties such as hardness, elastic and shear moduli, and density. At 84, selected model drilling parameters may be applied to the modeled drill string and BHA. At 85, a solution is determined for the drill string and BHA in the wellbore in view of the applied forces (WOB, RPM) and friction of the drill string and BHA along the wellbore. At 86, the response of the drill string and BHA to the applied forces, i.e., change in depth and change in direction may be calculated based on the factors input and calculated at 84 and 85. At 87, the process is repeated for increments of depth traversed by the drill string and BHA and the response of the drill string and BHA with respect to depth and direction is recorded. At 88, a characteristic response of the selected drill string and BHA (which includes the selected steerable motor and drill bit) to applied WOB and operating rate of the steerable motor may be calculated and used as an initial predicted steering (directional) response to the selected drilling operating parameters. One example of such modeling is described in U.S. Pat. No. 7,139,689 issued to Huang.

In other embodiments, the foregoing modeling of directional response may be omitted and, for example, the steerable motor manufacturer's specifications for steering response may be used.

Using the foregoing examples of initial steering response (defined as change in wellbore trajectory with respect to measured toolface, WOB, and bit RPM based on mud flow rate and steerable motor hydraulic specifications) as a starting point, during the drilling of the wellbore, an actual steering response of the drill string and BHA with respect to measured toolface, WOB and RPM may be determined and the foregoing may be used to calculate a depth weighted average.

Using the foregoing measured drilling response during slide drilling, a relationship between the measured toolface and the actual steering response may be determined. Using the determined relationship, it may be possible to determine a particular toolface orientation to use to most effectively steer the well along the desired path. The relationship between measured toolface and actual steering response may be continually adjusted during the drilling procedure.

During rotary drilling, the well trajectory may be assumed to remain constant or may have a predetermined or measured "walk tendency" (change in trajectory during rotary drilling) may be included (examples include walk or inclination build/drop tendencies). When slide drilling a selected distance, dMD, the well trajectory turns in the direction of the toolface orientation (adjusted by the above empirical relationship by an amount proportional to dMD). The constant of proportionality, C, may be updated during drilling as follows. Between consecutive directional surveys made in the wellbore (e.g., using the MWD instrument), the "slide curve rate" (SCR) may be estimated as:

$$A/(SD*TDF)$$

where A represents the angular difference between the wellbore orientation between the two directional surveys; SD represents the total measured depth of slide drilling between the surveys; and TDF represents the "turn direction factor:"

TDF ranges from zero to unity. A TDF=1 represents the well trajectory always turning in the same direction. The TDF decreases with fluctuating turn direction during slide drilling.

If estimated walk tendency of the BHA while rotary drilling is known or determinable and is nonzero, the above equation for SCR may be adjusted by replacing A with the angular difference between the final wellbore orientation and the expected wellbore orientation after rotary drilling an amount RD from the initial orientation. RD represents the total measured depth of rotary drilling between successive surveys.

C, as previously explained, may be calculated as a function of the SCR values computed above. Examples include weighted averages of SCR values, with weights based on some combination of: temporal proximity, depth proximity, fractional or absolute amount of slide drilling included in the associated survey interval, TDF magnitude, relation to detected change-points estimated from SCR or other values, and outlier metrics among other things. C could also be extrapolated from trends in SCR (in the current well or even offset wells) or SCR values combined with trends estimated by physics-based models. Said trends could be based on any combination of: time, depth, spatial position, spatial orientation, drilling parameters, and values derived therefrom. Any combination of these techniques may be used.

Prior to any slide drilling, a default value of C may be used, e.g., calculated using the above described modeling procedure, using values obtained from nearby wells when drilling through similar formations, possibly adjusted for the mechanical properties of the drill string and steerable motor where they are different than those used to drill the nearby wells, or may be selected arbitrarily.

The TDF may be calculated for a toolface measurements made over a selected depth interval as follows. First, convert the well trajectory turn direction (0-360 deg) into a complex number (0->1, 90->i, 180->−1, 270->−i, . . . ). The trajectory turn values may be averaged over the selected depth interval the modulus of the result may be calculated. As an example: slide drill 66 feet with toolface=0°, then slide drill 33 feet with toolface=180° between two surveys points, assuming a uniform 10 degrees per 100 feet curve rate. It may be expected that the well inclination would increase 6.6° (with no change in azimuth direction) and then drop 3.3° for a net change of 3.3° increase in inclination with no change in azimuth. Dividing the net inclination change by the total slide drilling depth interval yields 3.3° per 99 feet, where the total possible turn is 10° per 100 feet drilled interval. Thus, the example TDF=1/3. The net turn direction factor is only about 33% of the possible sliding curve rate due to the toolface not being maintained in a constant direction during slide drilling. Dividing by this triples the angle change to give the desired sliding curve rate.

$$TDF=\{1*66+(-1)*33\}/99=1/3$$

When updating C, the fact that the MWD instrument direction and inclination is not always aligned with the wellbore is taken into account where feasible. For example, the MWD instrument being smaller in diameter than the wellbore and rigidly attached to the drill string below it often causes the MWD instrument to partially align with deeper portions of the wellbore (generally in a range of 3 to 10 feet). Therefore SD and TDF are measured in an offset depth range: range [md1+D1,md2+D2], wherein md1, md2 are the directional survey measurement depths. D1 and D2 may be assumed to be constant or a function of the well trajectory, BHA/drill string mechanical properties, and potentially other factors such as weight on bit.

Directional walk tendency while rotary drilling may also be measured while drilling. For example, if no slide drilling occurred between two directional surveys, the magnitude of the tendency may be estimated as A/MD where A is the well trajectory's angular difference between the two survey locations and MD is the total measured depth drilled between the two survey locations. This may be performed when there is no significant "buffer" zone of only rotary drilling before the first survey location and after the second survey location. The foregoing may also better enable exclusion of MWD misalignment as described in the previous paragraph. The direction of the rotary drilling walk tendency may also be computed from the difference between the two successive surveys. Rotary walk tendency may also be estimated in the presence of sliding using the methods described above, e.g., replacing A with an angular difference that accounts for the slide drilling. Rotary drilling walk tendencies computed by such methods may be used to estimate future rotary drilling walk tendencies, which can be taken into account in subsequent drilling recommendations.

In actual drilling operations, the actual toolface will fluctuate around the selected value, at least in part due to variability of the mechanical properties of the formations being drilled (and thus changes in WOB and consequent reactive torque exceeding the speed with which the driller or the automated system can adjust to restore the WOB to its selected value). A sliding efficiency factor (SEF) may be calculated and which quantifies how well toolface is maintained within any selected drilled depth interval. SEF has a range of zero to unity wherein zero represents a completely scattered toolface and, 1 represents exactly constant toolface over the entire selected drilled depth interval. It has been shown by experience to be able to attain SEF values on the order of 0.9.

In an attempted constant-toolface slide drilling interval: SEF=modulus(average(complex(toolface))), the term SEF*C replaces C when solving for d1 and d2. The system processor (55 in FIG. 2) may also be programmed to calculate a moving average of the difference between the expected and actual turn direction.

A physics-based model of the BHA may be incorporated to anticipate changes in C, SEF and/or SEF and/or changes in rotary drilling tendencies ahead of the bit as a function of various factors. These factors may include inclination, WOB, differential pressure (i.e., change in mud pump pressure from its value at zero WOB and therefore zero steerable motor load), and turn direction among others. These factors can be incorporated into the simple model function f in various ways. For example, if a physics-based model (see the Huang patent referred to above) predicts a certain increase in C when inclination changes from a first amount to a second amount, then the value of C in the function f may be likewise increased from its value described above in the same scenario.

A model of the subsurface formations may be included to anticipate changes in C, SEF and/or toolface orientation and/or changes in rotary drilling tendencies ahead of the drill bit as the formation being drilled changes. Such a model may be a full geologic formation model that may or may not be calibrated based on formation measurements in the wellbore being drilled or using correlation with formation measurements made in nearby ("offset") wells, or other wells. Formation layer boundary detection may be based on changes in drilling response parameters while the drilling operating parameters remain constant, for example, WOB and RPM remain constant but ROP changes. Additionally, if differential pressure remains constant and SEF changes, then it is likely that the bit has penetrated a formation with different rock properties (e.g., SEF decreases, formation is likely harder. SEF increases, formation is likely softer).

When toolface changes due to formation property or layer boundary inclination (dip) changes, the system processor may be programmed to automatically correct for such changes by displaying a different recommended WOB/differential pressure to a user interface (e.g., a display available to the driller) or by causing the drawworks controller (69 in FIG. 1) to release the drill string to cause the recommended WOB/differential pressure to be attained. In some embodiments, using automatic correlation of measurements between the current well and nearby ("offset") wells or the current well and a geologic model, the formation change can be predicted and the drilling operating parameters may be adjusted proactively, that is, prior to actually drilling a different formation.

When the motor build/turn capacity is larger than necessary to reach any intermediate target position or the final target position, the system may display suggested drilling operating parameters to the driller on a user interface (or execute the drilling operating parameters automatically) with higher-frequency toolface fluctuation (e.g., by varying WOB or by alternating between slide drilling and rotary drilling) to reduce dogleg severity. One possible implementation is to reduce occurrences of having to pull the drill string out of the wellbore due to insufficient well trajectory turn rate by using a higher turn capacity steerable motor and use the above described TF-fluctuation to keep the net well trajectory turn rate within that prescribed by the well plan, either the original well plan or the well plan as modified during drilling.

The system may be configured for a user, e.g., the driller, to override the calculated drilling operating parameters. The system processor may be programmed to accept as input user selected "override" drilling operating parameters and then calculate the resulting expected location and orientation of the wellbore at any measured depth ahead of the current depth to provide the user guidance on the quality of the parameter selection.

The drilling operating parameters may be executed manually by the driller or automatically as explained with reference to FIGS. 1 and 2. Regardless of the execution mechanism, the results will be monitored both from an execution and an effect standpoint. From an execution standpoint, the system may monitor the actual drilling operating parameters used as contrasted to the calculated drilling operating parameters, and if the as-executed drilling operating parameters result in the desired effect on wellbore steering and ROP performance. The processor may be programmed to generate and display to the user, e.g., to a user interface available to the driller, warnings as to conditions such as failure to execute the calculated drilling operating parameters within a selected tolerance range and/or failure of the well trajectory and/or ROP performance to fall within the predetermined values outside a selected tolerance range. Additionally, if the actual well trajectory deviates from the planned trajectory or calculated trajectory beyond a predetermined threshold, the processor may recalculate the drilling operating parameters such that a revised planned well trajectory may fall within the predetermined threshold deviation from the originally planned wellbore trajectory.

One element of the monitoring process is determining when the drill string is sliding or rotating. Existing methods perform such monitoring automatically using measurements of top drive RPM or torque, but are susceptible to error particularly when the top drive is used to adjust toolface orientation or "rock" the pipe to decrease axial friction while sliding. Example methods according to the present disclosure may use toolface orientation measurements from the MWD instrument and other data as a backup measurement (when available) for confirmation of whether slide drilling or rotary drilling is underway at any time. The present example method may identify intervals of measured depth as sliding when certain measures of the scatter of the measured toolface orientations are below a predetermined threshold. Examples of such a measure include variance, absolute deviation, range, and measures of the deviation between consecutive toolface orientation measurements. If available, other drilling parameters may be used, including without limitation surface and downhole RPM, ROP, differential pressure (defined above), wellbore depth, block or top drive elevation, block or top drive velocity, bit depth and WOB among other parameters. Determining whether sliding drilling or rotary drilling is underway at any time may be used to estimate the SCR values which are in turn used to compute C. Determining times of slide drilling and rotary drilling also enables the calculation of "virtual survey points" at the position of the drill bit at any particular measured depth. These "virtual survey points" may be used for subsequent well path construction and user feedback. The virtual survey points may be located between or beyond actual directional survey points at times when the steerable motor toolface is measured. A cone of uncertainty may be calculated based on the distance from the last actual directional survey point as well as signal quality of the intermediate measure points. The cone of uncertainty expands until the next actual directional survey is taken, but the virtual survey points may still allow drilling personnel to make better informed decisions concerning adjustment of the well trajectory at any position along the well.

Virtual survey points may be calculated by 1) rotary drilling assuming a straight path (or optionally including an empirically determined trajectory change tendency); 2) slide drilling use the value of C and the measured toolface to estimate the position and orientation of the wellbore at any bit position. Virtual survey points may be used to update the starting point for any subsequent well path segment, or may be used to adjust one or more drilling operating parameters.

C may be used for other applications including detecting problems with the steerable motor and detecting formation changes.

Figure 5:
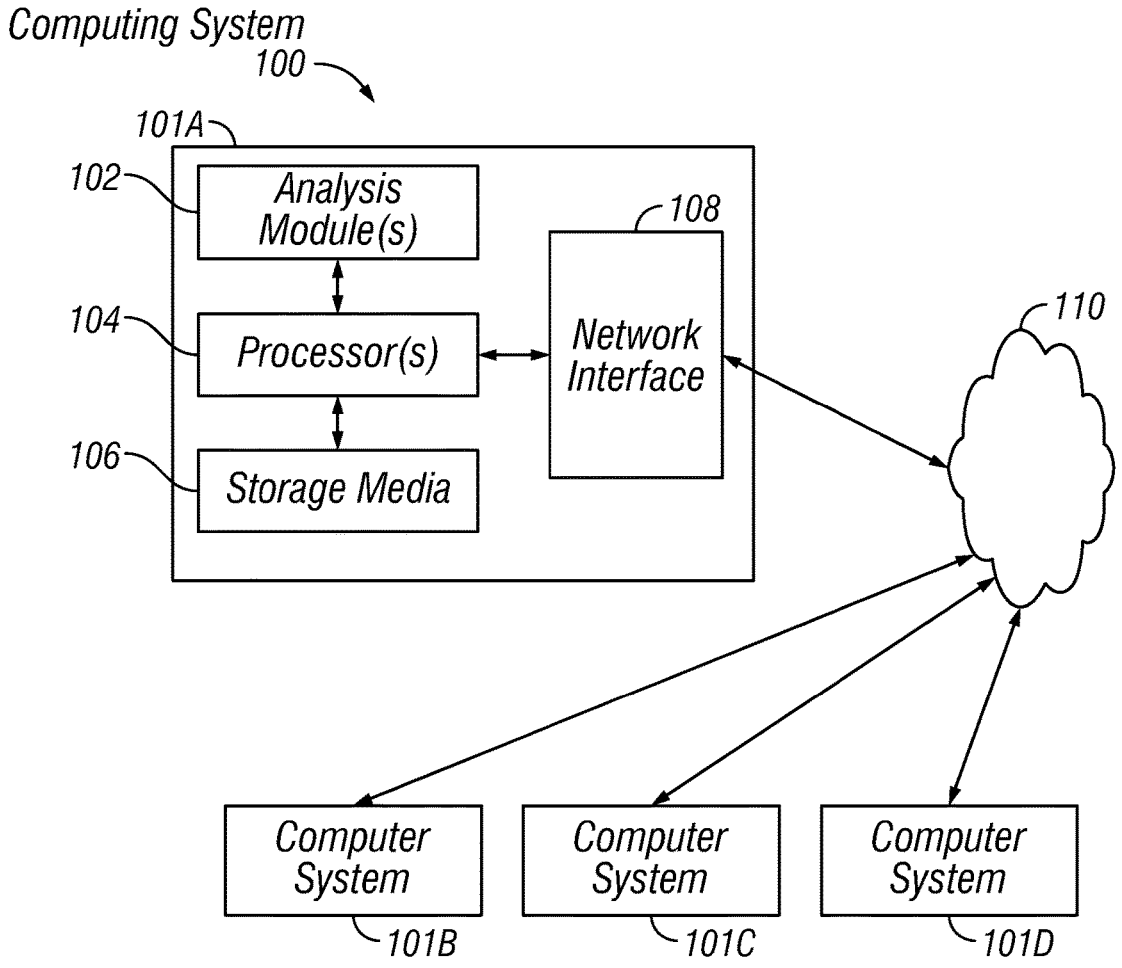
FIG. 5 shows an example computer system that may be used in some embodiments.

FIG. 5 shows an example computing system 100 in accordance with some embodiments. The computing system 100 may be an individual computer system 101A or an arrangement of distributed computer systems. The computer system 101A may include the processor (55 in FIG. 2) as one of its functional components, and may include one or more analysis modules 102 that may be configured to perform various tasks according to some embodiments, such as the tasks explained above, and in particular those tasks described with reference to FIGS. 3 and 4. To perform these various tasks, analysis module 102 may execute independently, or in coordination with, one or more processors 104, which may be connected to one or more storage media 106. The processor(s) 104 may also be connected to a network interface 108 to allow the computer system 101A to communicate over a data network 110 with one or more additional computer systems and/or computing systems, such as 101B, 101C, and/or 101D (note that computer systems 101B, 101C and/or 101D may or may not share the same architecture as computer system 101A, and may be located in different physical locations, for example, computer system 101A may be at a well drilling location, while in communication with one or more computer systems such as 101B, 101C and/or 101D that may be located in one or more data centers on shore, aboard ships, and/or located in varying countries on different continents). Computer system 101A, for example, may include the above described user interface available for use by the driller.

A processor may include a microprocessor, microcontroller, processor module or subsystem, programmable integrated circuit, programmable gate array, or another control or computing device.

The storage media 106 can be implemented as one or more computer-readable or machine-readable storage media. Note that while in the example embodiment of FIG. 5 the storage media 106 are depicted as within computer system 101A, in some embodiments, the storage media 106 may be distributed within and/or across multiple internal and/or external enclosures of computing system 101A and/or additional computing systems. Storage media 106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the instructions discussed above may be provided on one computer-readable or machine-readable storage medium, or alternatively, can be provided on multiple computer-readable or machine-readable storage media distributed in a large system having possibly plural nodes. Such computer-readable or machine-readable storage medium or media may be considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is only one example of a computing system, and that computing system 100 may have more or fewer components than shown, may combine additional components not depicted in the example embodiment of FIG. 5, and/or computing system 100 may have a different configuration or arrangement of the components depicted in FIG. 5. The various components shown in FIG. 5 may be implemented in hardware, software, or a combination of both hardware and software, including one or more signal processing and/or application specific integrated circuits.

Further, the steps in the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for wellbore directional drilling, comprising:

selecting an initial spatial position and a final spatial position of at least one portion of a wellbore;

in a computer, calculating a sequence of sliding drilling and rotary drilling operations within the at least one portion to enable drilling the wellbore along the at least one portion along a predicted trajectory, the sequence comprising at least one drilling operating parameter, the sequence comprising at least one constraint on (i) the at least one drilling operating parameter or (ii) a calculated result of at least one drilling operating parameter, the predicted trajectory calculated using a projected steering response of a steerable motor in response to the at least one drilling operating parameter;

starting drilling the at least one portion of the wellbore;

automatically detecting slide drilling after starting drilling of the at least one portion, wherein the automatically detecting comprises comparing measurements scatter of measured toolface orientations to a predetermined threshold;

determining a spatial position of the wellbore during drilling at at least one point intermediate the initial spatial position and the final spatial position; and using a relationship between the projected steering response and the at least one drilling operating parameter, adjusting the at least one drilling operating parameter and/or the at least one constraint based on the determined spatial position and the final spatial position.

2. The method of claim 1 further comprising calculating a difference between an actual well trajectory change response compared to a predicted well trajectory change response with respect to a steerable motor toolface orientation during drilling the at least one portion and updating a planned wellbore trajectory based on the difference.

3. The method of claim 1 wherein the relationship comprises a weighted moving average of a steerable motor steering response with respect to the at least one drilling parameter, and wherein weights for the weighted moving average comprise one or more members selected from a group consisting of a weight related to a distance from a bottom of a well to a point of the measured wellbore trajectory response, a weight related to a fractional amount of time during drilling the at least one section comprising slide drilling, a zero weight for determined outlier measured toolface orientations, and a weight on bit related to a toolface direction factor.

4. The method of claim 1 further comprising stopping drilling operating and changing at least one component of a drilling tool assembly when, using the relationship, it is determined that the final spatial position cannot be reached by adjusting the at least one drilling parameter and/or the at least one constraint.

5. The method of claim 1 wherein the determining a spatial position of the wellbore during drilling comprises at least one member selected from a group consisting of measuring a directional survey, and calculating a virtual directional survey point at a selected drill bit location along the at least one section different than a spatial position of the wellbore calculated from a directional survey made using a directional survey instrument.

6. The method of claim 5 comprising calculating the virtual directional survey point and further comprising using the virtual directional survey point to adjust the at least one drilling operating parameter to change a trajectory ahead of a lowermost position of the wellbore from a predetermined trajectory.

7. The method of claim 5 wherein calculating the virtual directional survey point comprises: (i) rotary drilling assuming a substantially constant wellbore trajectory or including an empirically determined trajectory change tendency; and (ii) slide drilling using a value of a weighted moving average and a measured steerable motor toolface to estimate a position and an orientation of the wellbore.

8. The method of claim 1 wherein the comparing determines that the measurements scatter of measured toolface orientations is less than the predetermined threshold.

9. The method of claim 1 wherein the measurements scatter of measured toolface orientations comprises a variance of measured toolface orientations.

10. The method of claim 1 wherein the measurements scatter of measured toolface orientations comprises an absolute deviation of measured toolface orientations.

11. The method of claim 1 wherein the measurements scatter of measured toolface orientations comprises measures of deviation between consecutive toolface orientation measurements.

12. The method of claim 1 wherein the measurements scatter of measured toolface orientations comprises a range of measured toolface orientations.

13. A non-transitory computer-readable medium storing instructions executable by a computing system to instruct the computing system to:

select an initial spatial position and a final spatial position of at least one portion of a wellbore;

calculate a sequence of sliding drilling and rotary drilling operations within the at least one portion to enable drilling the wellbore along the at least one portion along a predicted trajectory, the sequence comprising at least one drilling operating parameter, the sequence comprising at least one constraint on (i) the at least one drilling operating parameter or (ii) a calculated result of at least one drilling operating parameter, the predicted trajectory calculated using a projected steering response of a steerable motor in response to the at least one drilling operating parameter;

compare measurements scatter of measured toolface orientations to a predetermined threshold to automatically detect slide drilling after a start of drilling of the at least one portion;

determine a spatial position of the wellbore during drilling at least one point intermediate the initial spatial position and the final spatial position; and use a relationship between the projected steering response and the at least one drilling operating parameter to adjust the at at least one drilling operating parameter and/or the at least one constraint based on the determined spatial position and the final spatial position.

14. The non-transitory computer-readable medium of claim 13, further comprising instructions to: calculate a difference between an actual well trajectory change response compared to a predicted well trajectory change response with respect to a steerable motor toolface orientation during drilling the at least one portion and updating a planned wellbore trajectory based on the difference.

15. A system comprising:

a processor;

memory accessible to the processor;

instructions executable by the processor and stored in the memory to instruct the system to:

select an initial spatial position and a final spatial position of at least one portion of a wellbore;

calculate a sequence of sliding drilling and rotary drilling operations within the at least one portion to enable drilling the wellbore along the at least one portion along a predicted trajectory, the sequence comprising at least one drilling operating parameter, the sequence comprising at least one constraint on (i)

the at least one drilling operating parameter or (ii) a calculated result of at least one drilling operating parameter, the predicted trajectory calculated using a projected steering response of a steerable motor in response to the at least one drilling operating parameter;

compare measurements scatter of measured toolface orientations to a predetermined threshold to automatically detect slide drilling after a start of drilling of the at least one portion;

determine a spatial position of the wellbore during drilling at least one point intermediate the initial spatial position and the final spatial position; and use a relationship between the projected steering response and the at least one drilling operating parameter to adjust the at at least one drilling operating parameter and/or the at least one constraint based on the determined spatial position and the final spatial position.

16. The system of claim 15 comprising instructions to calculate a difference between an actual well trajectory change response compared to a predicted well trajectory change response with respect to a steerable motor toolface orientation during drilling the at least one portion and updating a planned wellbore trajectory based on the difference.

17. The system of claim 15 wherein the relationship comprises a weighted moving average of a steerable motor steering response with respect to the at least one drilling parameter, and wherein weights for the weighted moving average comprise one or more members selected from a group consisting of a weight related to a distance from a bottom of a well to a point of the measured wellbore trajectory response, a weight related to a fractional amount of time during drilling the at least one section comprising slide drilling, a zero weight for determined outlier measured toolface orientations, and a weight on bit related to a toolface direction factor.

18. The system of claim 15 comprising instructions to stop drilling operating to change at least one component of a drilling tool assembly when, using the relationship, it is determined that the final spatial position cannot be reached by adjustment of the at least one drilling parameter and/or the at least one constraint.

19. The system of claim 15 wherein to determine a spatial position of the wellbore during drilling comprises calculation of a virtual directional survey point at a selected drill bit location along the at least one section different than a spatial position of the wellbore calculated from a directional survey made using a directional survey instrument and using the virtual directional survey point to adjust the at least one drilling operating parameter to change a trajectory ahead of a lowermost position of the wellbore from a predetermined trajectory.

20. The system of claim 15 wherein the measurements scatter of measured toolface orientations comprises at least one member selected from a group consisting of a variance of measured toolface orientations, an absolute deviation of measured toolface orientations, a range of measured toolface orientations, measures of deviation between consecutive toolface orientation measurements, a norm of an average of vectors representing measured toolface orientations, and a modulus of an average of complex numbers representing measured toolface orientations.

* * * * *